US005957110A

United States Patent [19]

Yoshioka

[11] Patent Number: 5,957,110

[45] Date of Patent: Sep. 28, 1999

[54] IGNITION TIMING CONTROL DEVICE OF AN ENGINE

[75] Inventor: Mamoru Yoshioka, Susono, Japan

[73] Assignee: Toyota Jidosha Kabushiki Kaisha, Aichi, Japan

[21] Appl. No.: 08/955,119

[22] Filed: Oct. 21, 1997

[30] Foreign Application Priority Data

Oct. 25, 1996 [JP] Japan ..... 8-284007

[51] Int. Cl.[6] ..... F02P 5/145

[52] U.S. Cl. ..... 123/406.49; 123/406.55

[58] Field of Search ..... 123/406.49, 406.55

[56] References Cited

U.S. PATENT DOCUMENTS

| | | | |
|---|---|---|---|
| 4,307,691 | 12/1981 | Nagae et al. | 123/406.49 |
| 4,494,512 | 1/1985 | Kishi et al. | 123/677 |
| 4,526,148 | 7/1985 | Narasaka et al. | 123/677 |
| 4,558,674 | 12/1985 | Okado et al. | 123/406.49 |
| 4,590,563 | 5/1986 | Matsumura et al. | 123/406.49 |
| 5,016,590 | 5/1991 | Ohkumo | 123/406.49 |

FOREIGN PATENT DOCUMENTS

| | | |
|---|---|---|
| 54-153929 | 12/1979 | Japan . |
| 57-61171 | 4/1982 | Japan . |
| 58-65950 | 4/1983 | Japan . |
| 59-165866 | 9/1984 | Japan . |
| 60-201035 | 10/1985 | Japan . |
| 60-219460 | 11/1985 | Japan . |
| 61-205377 | 9/1986 | Japan . |
| 63-124865 | 5/1988 | Japan . |
| 5-44564 | 2/1993 | Japan . |
| 5-71455 | 3/1993 | Japan . |
| 8-121303 | 5/1996 | Japan . |
| 8-200191 | 8/1996 | Japan . |

*Primary Examiner*—Erick R. Solis
*Attorney, Agent, or Firm*—Kenyon & Kenyon

[57] ABSTRACT

An ignition timing control device including a mass flow meter arranged in the intake passage. At the time engine warmup, at high load operation where the mass flow rate of the intake air is higher than the reference value, the ignition timing is made a basic ignition timing for engine warmup. As opposed to this, in medium load operation, where the mass flow rate of the intake air is lower than the reference value, the ignition timing is retarded from the basic ignition timing of engine warmup. When the atmospheric pressure falls, the reference value is lowered.

11 Claims, 9 Drawing Sheets

IGNITION TIMING CONTROL DEVICE OF AN ENGINE

BACKGROUND OF THE INVENTION

1. Field of the Invention

The present invention relates to an ignition time control device of an engine.

2. Description of the Related Art

To obtain good combustion at engine warmup when the engine temperature is low, it is necessary to advance the ignition timing compared with after warmup is completed. Therefore, in conventional engines, a reference ignition timing for warmup operation required for obtaining good combustion is found in advance by experiments and the ignition timing controlled to this reference ignition timing at the time of engine warmup.

On the other hand, in an internal combustion engine providing an exhaust gas purifying catalyst in the engine exhaust passage, it is necessary to have the exhaust gas purification action start as fast as possible after engine startup. Therefore, it is necessary to cause the temperature of the catalyst to rise as quickly as possible after engine startup. In an internal combustion engine, however, the temperature of the exhaust gas rises when the ignition timing is retarded. Accordingly, if the ignition timing is retarded from the reference ignition timing of engine warmup, it becomes possible to cause the temperature of the catalyst to rise early after engine startup.

In this case, however, if the ignition timing is retarded during engine high load operation, high engine output can no longer be obtained. That is, if the ignition timing is retarded during engine high load operation, high output can no longer be obtained when the vehicle driver desires a high output. Therefore, it is not desirable to retard the ignition timing during engine high load operation. Further, if the ignition timing is retarded during idling, the combustion becomes unstable. Therefore, it is not desirable to retard the ignition timing during engine idling.

Accordingly, there is known an internal combustion engine designed so as to control the ignition timing to a reference ignition timing during high load operation at the time of engine warmup or at the time of idling and so as to retard the ignition timing with respect to the reference ignition timing to promote the warming of the catalyst at the time of other operating states, that is, engine low load and medium load operation (see Japanese Unexamined Patent Publication (Kokai) No. 61-205377).

At the time of engine warmup in such an internal combustion engine, however, when deciding whether the operating state is a high load operating state where the ignition timing should be made the reference timing or the medium load operating state where the ignition timing should be retarded based on a representative value changing according to the atmospheric pressure and indicating the engine load, for example, the mass flow rate of the intake air or the absolute pressure in the intake passage downstream of the throttle valve, the problem arises that a high engine output cannot be obtained when driving a vehicle at a high altitude where the atmospheric pressure is low.

That is, in the case where, when the mass flow rate of the intake air is greater than a predetermined reference value at the time of engine warmup, for example, under the normal atmospheric pressure, it is judged that the operating state is one of a high load and the ignition timing is controlled to the reference ignition timing, even if the accelerator pedal is depressed hard when the vehicle is operating at a high altitude where the atmospheric pressure is low, the mass flow rate of the intake air will not reach the predetermined reference value and therefore it will be judged that the engine is operating at medium load. As a result, the ignition timing is retarded from the reference ignition timing and therefore a high output cannot be obtained even if the vehicle driver desires a high output.

SUMMARY OF THE INVENTION

The object of the present invention is to provide an ignition timing control device which enables a high engine output to be obtained when a driver of a vehicle desires a high engine output during engine warmup even when the vehicle is being driven at a high altitude with a low atmospheric pressure.

According to the present invention, there is provided an ignition timing control device for an engine having a spark plug, comprising ignition timing control means for controlling ignition timing to a reference ignition timing of engine warmup)advanced compared to after the completion of the engine warmup when a representative value changing in accordance with atmospheric pressure and indicating an engine load is at a higher load side from a predetermined reference value at the time of engine warmup, and retarding the ignition timing from the reference ignition timing of engine warmup when the representative value is at the low load side of the reference ignition timing of engine warmup at the time of engine warmup, and reference value control means for changing the reference value to the low load side when the atmospheric pressure falls from the normal atmospheric pressure.

BRIEF DESCRIPTION OF THE DRAWINGS

The present invention may be more fully understood from the description of preferred embodiments of the invention set forth below, together with the accompanying drawings, wherein.

DESCRIPTION OF THE PREFERRED EMBODIMENTS

Figure 1:
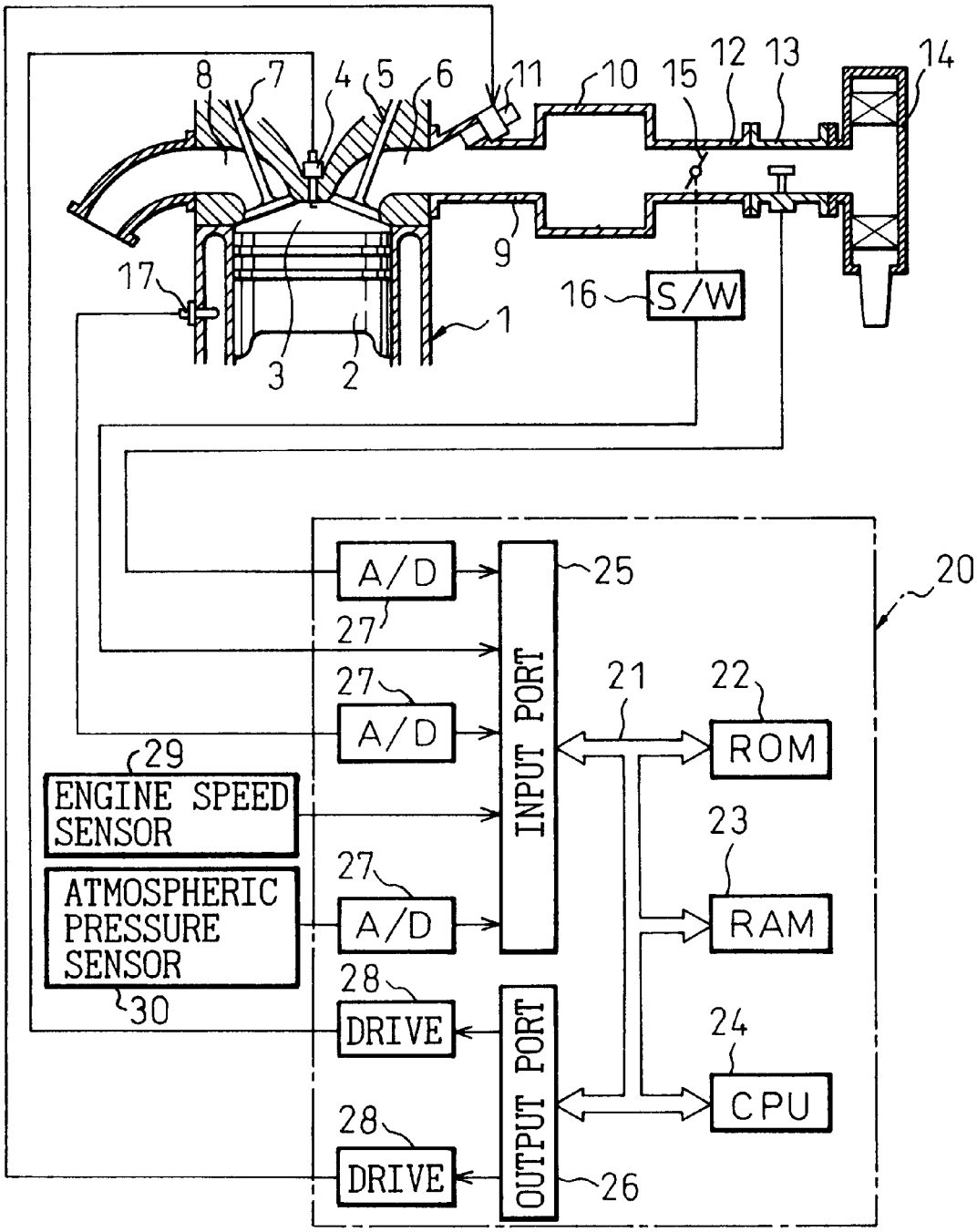
FIG. 1 is an overview of an internal combustion engine.

Referring to FIG. 1, 1 is an engine body, 2 is a piston, 3 is a combustion chamber, 4 is a spark plug arranged in the combustion chamber 3,5 is an intake valve, 6 is an intake port, 7 is an exhaust valve, and 8 is an exhaust port. The intake port 6 is connected through an intake tube 9 to a surge tank 10. Fuel injectors 11 are attached to the intake tubes 9. The surge tank 10 is connected through an intake duct 12 and mass flow meter 13 to an air cleaner 14. A throttle valve 15 is arranged in the intake duct 12.

An electronic control unit 20 is comprised of a digital computer which is provided with a read only memory (ROM) 22, a random access memory (RAM) 23, a microprocessor (CPU) 24, an input port 25, and an output port 26 connected with each other by a bidirectional bus 21. The mass flow meter 13 is comprised of a mass flow meter using for example a heating type platinum thin film. The mass flow meter 13 generates an output voltage proportional to the mass flow rate of the intake air. The output pressure is input through a corresponding AD converter 27 to an input port 25.

The throttle valve 15 has connected to it an idle switch 16 generating an output signal when the throttle valve 15 is at the idling position. The output signal of the idle switch 16 is input to the input port 25. The engine body 1 has a water temperature sensor 17 generating an output voltage proportional to the temperature of the engine cooling water. The output voltage of the water temperature sensor 17 is input through the corresponding AD converter 27 to the input port 25. Further, the input port 25 receives an output signal of the engine speed sensor 29 showing the engine speed. The atmospheric pressure sensor 30 generates an output voltage proportional to the atmospheric pressure. The output voltage is input through the corresponding AD converter 27 to the input port 25. On the other hand, the output port 26 is connected through a corresponding drive circuit 28 to the spark plugs 4 and fuel injectors 11.

In the embodiment shown in FIG. 1, the basic ignition timing tSA after the completion of the warmup is stored as a function of the mass flow rate GN (g/liter) of the intake air and the engine speed N (rpm) in advance in the ROM 22 in the form of a map shown in Table 1. After the completion of engine warmup, the ignition timing is made the basic ignition timing tSA stored in the map. Note that Table 1 shows just part of the basic ignition timing tSA. The numerical values show the crank angles before top dead center.

TABLE 1

| GN | N (rpm) | | | | | |
|---|---|---|---|---|---|---|
| (g/l) | 800 | 1600 | 2400 | 3200 | 4000 | 4800 |
| 0.25 | 20 | 30 | 40 | 41 | — | — |
| 0.5 | 25 | 35 | 38 | 41 | — | — |
| 0.75 | 25 | 33 | 35 | 38 | — | — |
| 1.00 | 20 | 28 | 30 | 33 | — | — |
| 1.25 | 15 | 23 | 25 | 28 | — | — |
| 1.50 | 10 | 15 | 20 | 23 | — | — |
| 1.75 | 0 | 8 | 15 | 20 | — | — |

The smaller the mass flow rate GN of the intake air, that is, the lower the engine load, the densities of the air and fuel in the combustion chamber 3 become lower, so the rate of combustion becomes slower and therefore, as will be understood from Table 1, the basic ignition timing tSA is advanced the smaller the mass flow rate GN of the intake air. Further, the higher the engine speed N, the shorter the time by which the crank shaft turns by the same crank angle, so the basic ignition timing tSA is advanced the higher the engine speed as shown in Table 1.

Figure 2:
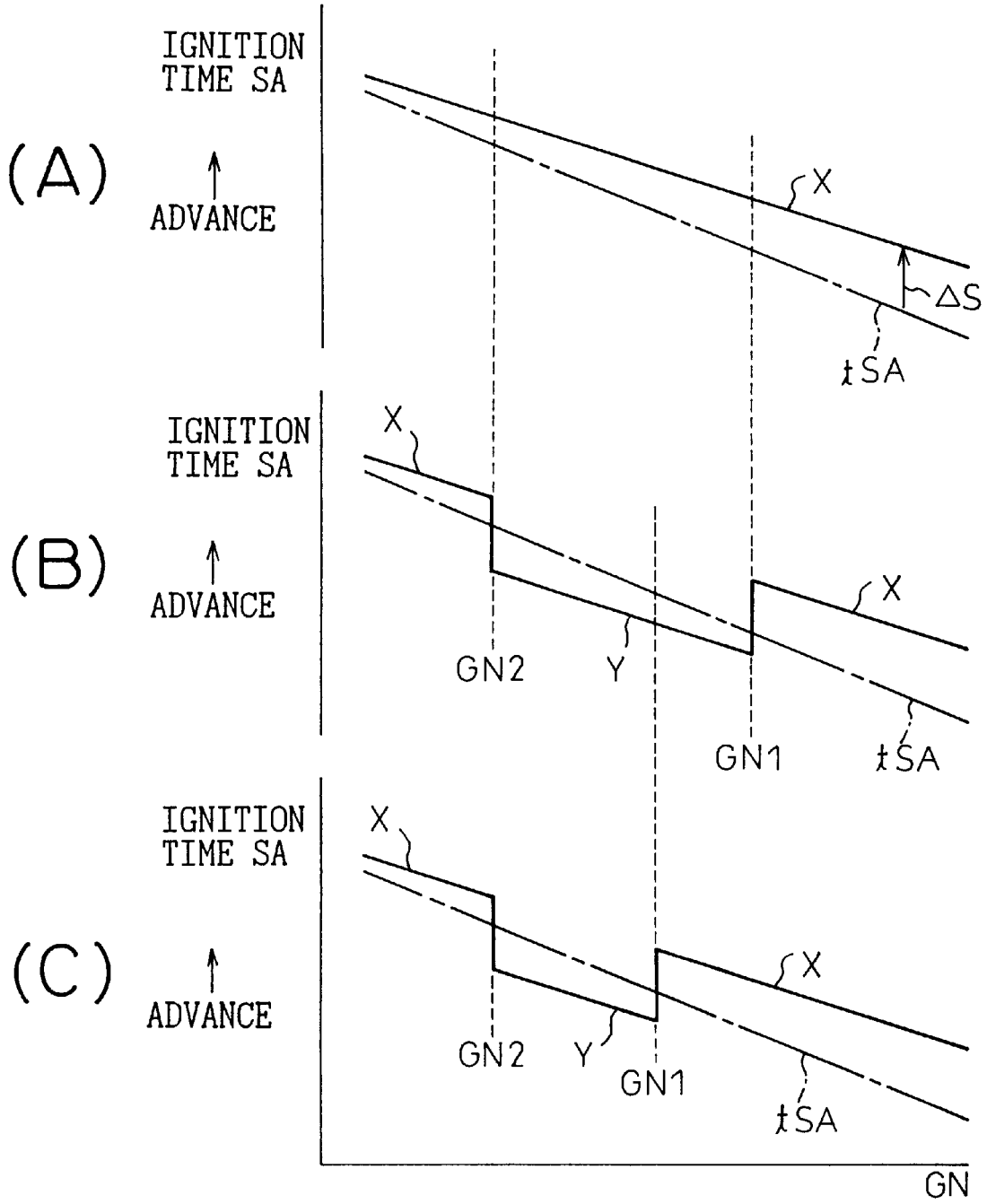
FIG. 2 is a view explaining the basic thinking of ignition timing control.

Next, an explanation will be made of the basic thinking in the ignition timing control according to the present invention with reference to FIG. 2. FIGS. 2(A), 2(B), and 2(C) show the changes in the ignition timing SA when the mass flow rate GN of the intake air changes under the same engine speed N. Note that in FIGS. 2(A), 2(B), and 2(C), the broken lines show the basic ignition timing tSA after the end of the engine warmup. The solid lines show ignition timing before the completion of the warmup.

The solid line in FIG. 2(A) shows the basic ignition timing X of engine warmup required for obtaining good combustion during engine warmup. During engine warmup, the engine temperature is low, so the rate of combustion is slow and therefore as shown in FIG. 2(A), the basic ignition timing X of engine warmup is advanced with respect to the basic ignition timing tSA after the completion of the warmup. Further, the amount of advance ΔS becomes greater the larger the mass flow rate GN of the intake air.

On the other hand, FIG. 2(B) shows the case where the ignition timing is made the reference ignition timing of engine warmup at the time of high load operation during engine warmup where the mass flow rate GN of the intake air is greater than the reference value GN1 and at the time of low load operation during engine warmup where the mass flow rate GN of the intake air is smaller than the reference value GN2 and where the ignition timing is retarded from the reference ignition timing X as shown by Y at the time of medium load operation during engine warmup where the mass flow rate GN of the intake air is between the reference value GN1 and the reference value GN2.

If the ignition timing is retarded from the reference ignition timing X as shown by Y, the temperature of the exhaust gas rises, so the warming of the exhaust gas purification catalyst arranged in the engine exhaust passage is promoted. On the other hand, at the time of engine high load operation during engine warmup where GN>GN1, the ignition timing is made the reference ignition timing X of engine warmup and therefore at this time a high output is obtained. That is, when the vehicle operator steps on the accelerator pedal and wants a high output, a high output can be obtained. On the other hand, at the time of low load operation during engine warmup where GN<GN2 as well, the ignition timing is made the basic ignition timing X of engine warmup and therefore it is possible to secure stable combustion at this time.

As shown in FIG. 2(B), however, when the reference value GN1 has been set and the vehicle is being driven at a high altitude where the atmospheric pressure is low, even if the accelerator pedal is stepped down on hard, the mass flow rate GN of the intake air will no longer reach GN1 and therefore at the time the ignition timing is retarded as shown by Y. As a result, the vehicle driver cannot obtain a high output even if wanting it.

Therefore, in the present invention, when the atmospheric pressure is the normal atmospheric pressure, the reference value GN1 is set as shown in FIG. 2(B). When the atmospheric pressure falls, the reference value GN1 is reduced as shown in FIG. 2(C). In this way, if the reference value GN1 is reduced when the atmospheric pressure falls, when the accelerator pedal is stepped down on hard, the mass flow rate GN of the intake air will exceed the reference value GN1 and therefore the ignition timing will be made the reference ignition timing X. Therefore, even when the vehicle is driven at a high altitude where the atmospheric pressure is low, the vehicle driver can obtain a high output when desiring a high output.

Figure 3:
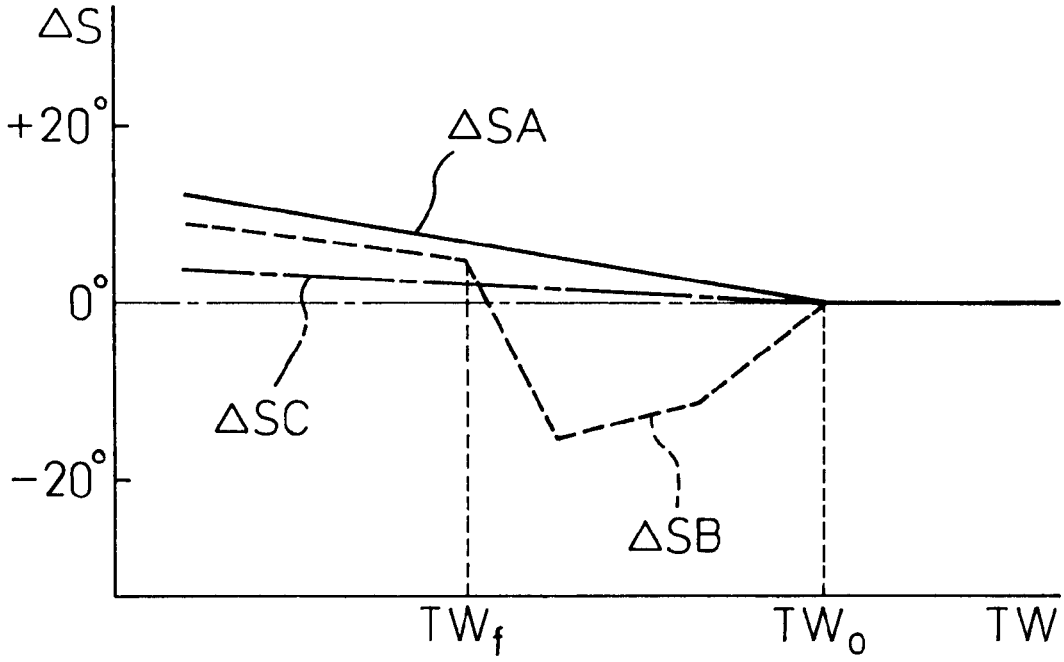
FIG. 3 is a view of an amount of advance.

FIG. 3 shows the amount of advance ΔS of the ignition timing of engine warmup with respect to the basic ignition timing tSA after the completion of warmup. Note that the abscissa TW shows the temperature of the engine cooling water. When the engine cooling water temperature TW is lower than a certain temperature $TW_O$, for example, 70° C., it is decided that the engine is warming up. Further, in FIG. 3, ΔSA shows the amount of advance at the time of engine high load operation, ΔSC shows the amount of advance at the time of engine light load operation except for idling, and ΔSC shows the amount of advance at the time of idling.

As shown in FIG. 3, the amount of advance ΔSA at the time of engine high load operation and the amount of advance ΔSC at the time of idling operation are increased the lower the engine cooling water temperature TW. In this case, ΔSA+tSA (tSA is the basic ignition timing after the completion of engine warmup) shows the basic ignition timing of engine warmup at the time of high load operation. When it is decided that the engine is operating at high load during warmup, the ignition timing is made the basic ignition timing (ΔSA+tSA). Further, ΔSC+tSA shows the basic ignition timing of engine warmup at the time of idling operation. When it is decided that the engine is idling during warmup, the ignition timing is made the basic ignition timing (ΔSC+tSA).

On the other hand, ΔSB+tSA when the engine cooling water temperature TW is lower than a certain value $TW_f$, for example, 0° C., shows the basic ignition timing of engine warmup at the time of engine light load operation. Therefore, at the time of light load operation when the engine cooling water temperature TW is between $TW_f$ and $TW_O$, it is learned, the ignition timing is retarded from the basic ignition timing of engine warmup as shown by ΔSB.

Further, the amount of advance ΔS at the time of engine medium load operation during engine warmup is calculated by interpolation in accordance with the load from the amount of advance ΔSB at the time of light load operation and the amount of advance ΔSA at the time of high load operation. That is, when the load is lowest in the medium load operation region, the amount of advance ΔS becomes substantially ΔSB. When the load is highest in the medium load operating region, the amount of advance ΔS becomes substantially ΔSA. The amount of advance ΔS changes from ΔSB to ΔSA as the load changes from the lowest load to the highest load in the medium load operating region.

Therefore, during engine light load operation and during medium load operation, when the engine cooling water temperature TW is $TW_f<TW<TW_O$, the ignition timing is retarded with respect to the basic ignition timing of engine warmup corresponding to the load. At this time, there is a catalytic warming action.

Figure 4:
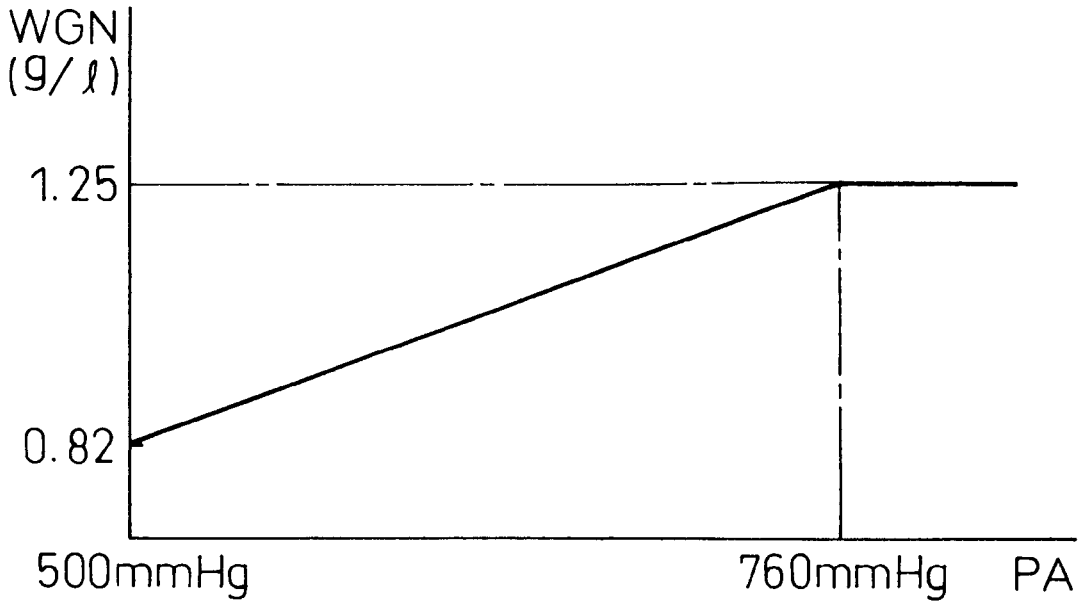
FIG. 4 is a view of a reference value WGN.

FIG. 4 shows the reference value WGN when deciding to use the amount of advance ΔSA for high loads or using the amount of advance (interpolation value between ΔSB and ΔSA) for medium loads as the amount of advance during engine warmup. This reference value WGN corresponds to GN1 in FIG. 2. The abscissa PA in FIG. 4 shows the atmospheric pressure. As shown in FIG. 4, the reference value WGN becomes small the lower the atmospheric pressure PA compared with the normal atmospheric pressure (760 mmHg).

Next, an explanation will be made of the routine for control of the ignition timing shown in FIG. 5.

Figure 5:
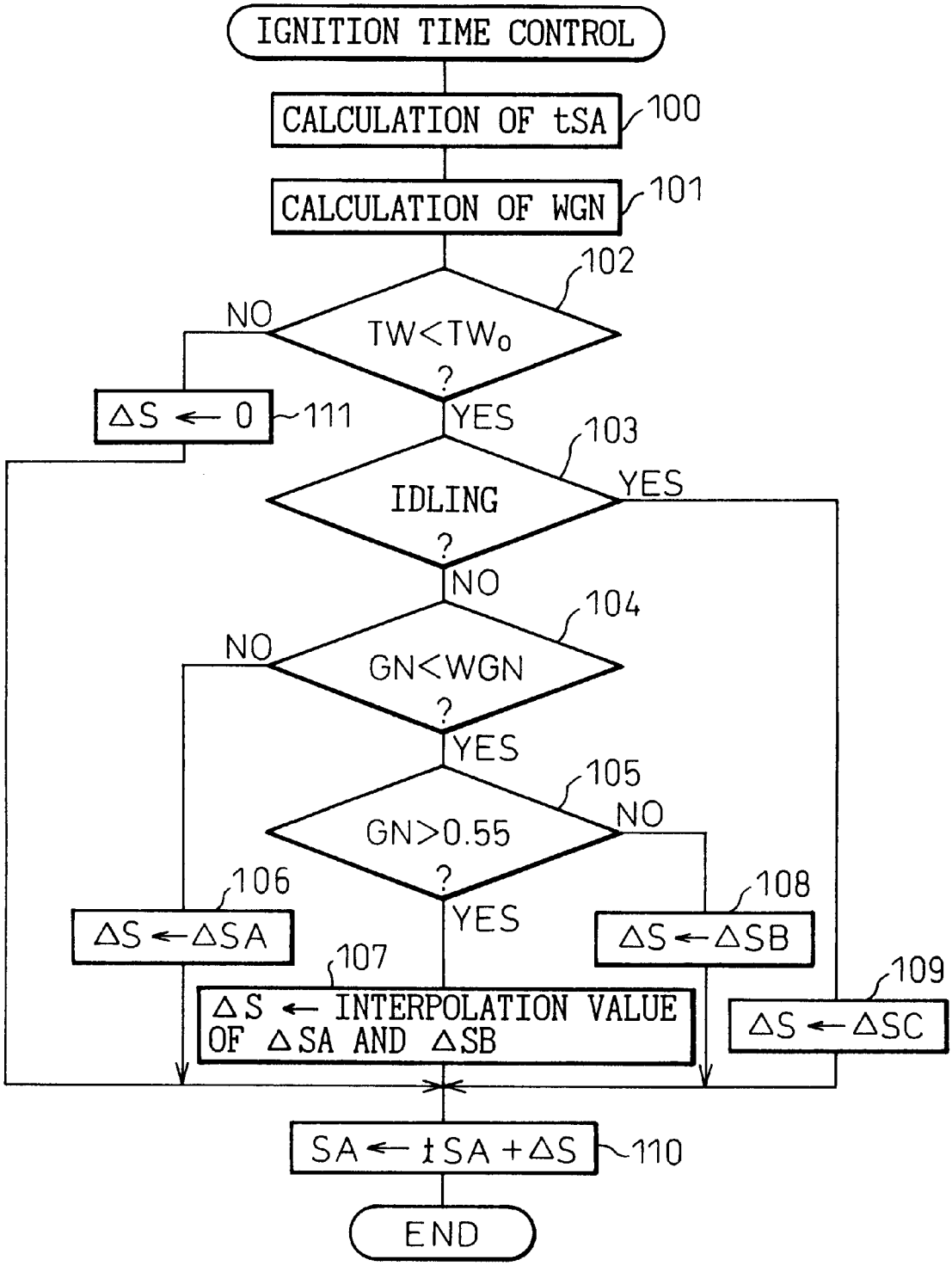
FIG. 5 is a flow chart for control of the ignition timing.

Referring to FIG. 5, first, at step 100, the basic ignition timing tSA after the completion of engine warmup is calculated from the map shown in Table 1. Next, at step 101, the reference value WGN is calculated from the relationship shown in FIG. 4 based on the atmospheric pressure PA detected by the atmospheric pressure sensor 30. Next, at step 102, it is decided if the engine cooling water temperature TW detected by the water temperature sensor 17 is lower than a certain value $TW_O$, that is, if the engine is warming up. When $TW \geqq TW_O$, that is, when the engine has finished warming up, the routine proceeds to step 111, where the amount of advance ΔS is made zero. Next, at step 110, the amount of advance ΔS is added to the basic ignition timing tSA after the completion of engine warmup to calculate the final ignition timing SA (=tSA+ΔS).

On the other hand, when it is decided at step 102 that $TW<TW_O$, that is, when the engine is warming up, the routine proceeds to step 103, where it is decided from the output signal of the idling switch 16 if the throttle valve 15 is at the idling position. When the throttle valve 15 is at the idling position, the routine proceeds to step 109, where the amount of advance ΔSC shown in FIG. 3 is made the amount of advance ΔS, then the routine proceeds to step 110. Therefore, at this time, the final ignition timing SA is made the basic ignition timing (tSA+ΔSC) of engine warmup at the time of idling.

On the other hand, when it is decided at step 103 that the throttle valve 15 is not at the idling position, the routine proceeds to step 104, where it is decided if the mass flow rate GN of the intake air detected by the mass flow meter 13 is smaller than the reference value WGN. When $GN \geqq WGN$, the routine proceeds to step 106, where the amount of advance ΔSA shown in FIG. 3 is made the amount of advance ΔS, then the routine proceeds to step 110. Therefore, at this time, the final ignition timing SA is made the basic ignition timing (tSA+ΔSA) of engine warmup at the time of high load operation. As shown in FIG. 4, the reference value WGN falls as the atmospheric pressure PA becomes lower. Therefore, even if the vehicle is being operated at a high altitude where the atmospheric pressure is low, if the accelerator pedal is stepped on hard, the ignition timing will be made the basic ignition timing (tSA+ΔSA) of engine warmup at the time of high load operation.

As opposed to this, when it is judged at step 104 that GN<WGN, the routine proceeds to step 105, where it is decided if the mass flow rate GN of the intake air is larger than a certain value, for example, 0.55 (g/liter). When $GN \leqq 0.55$, that is, when at the time of engine light load, the routine proceeds to step 108, where the amount of advance ΔSB shown in FIG. 3 is made the amount of advance ΔS, then the routine proceeds to step 110. Therefore, at this time, if the engine cooling water temperature TW is between $TW_f$ and $TW_O$ shown in FIG. 3, the ignition timing SA is retarded. On the other hand, when it is decided at step 105 that GN>0.55, the routine proceeds to step 107, where the interpolation value between ΔSA and ΔSB shown in FIG. 3 is made the amount of advance ΔS, then the routine proceeds to step 110. Therefore, at this time as well, if the engine cooling water temperature TW is between $TW_f$ and $TW_O$ shown in FIG. 3, the ignition timing SA is retarded.

Figure 6:
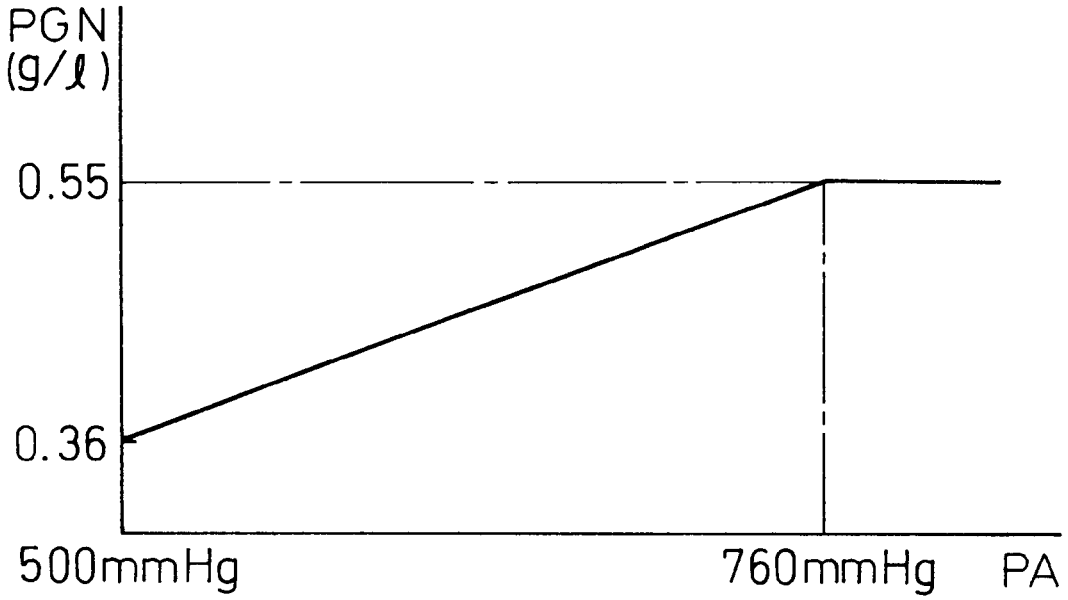
FIG. 6 is a view of the reference value PGN.
Figure 7:
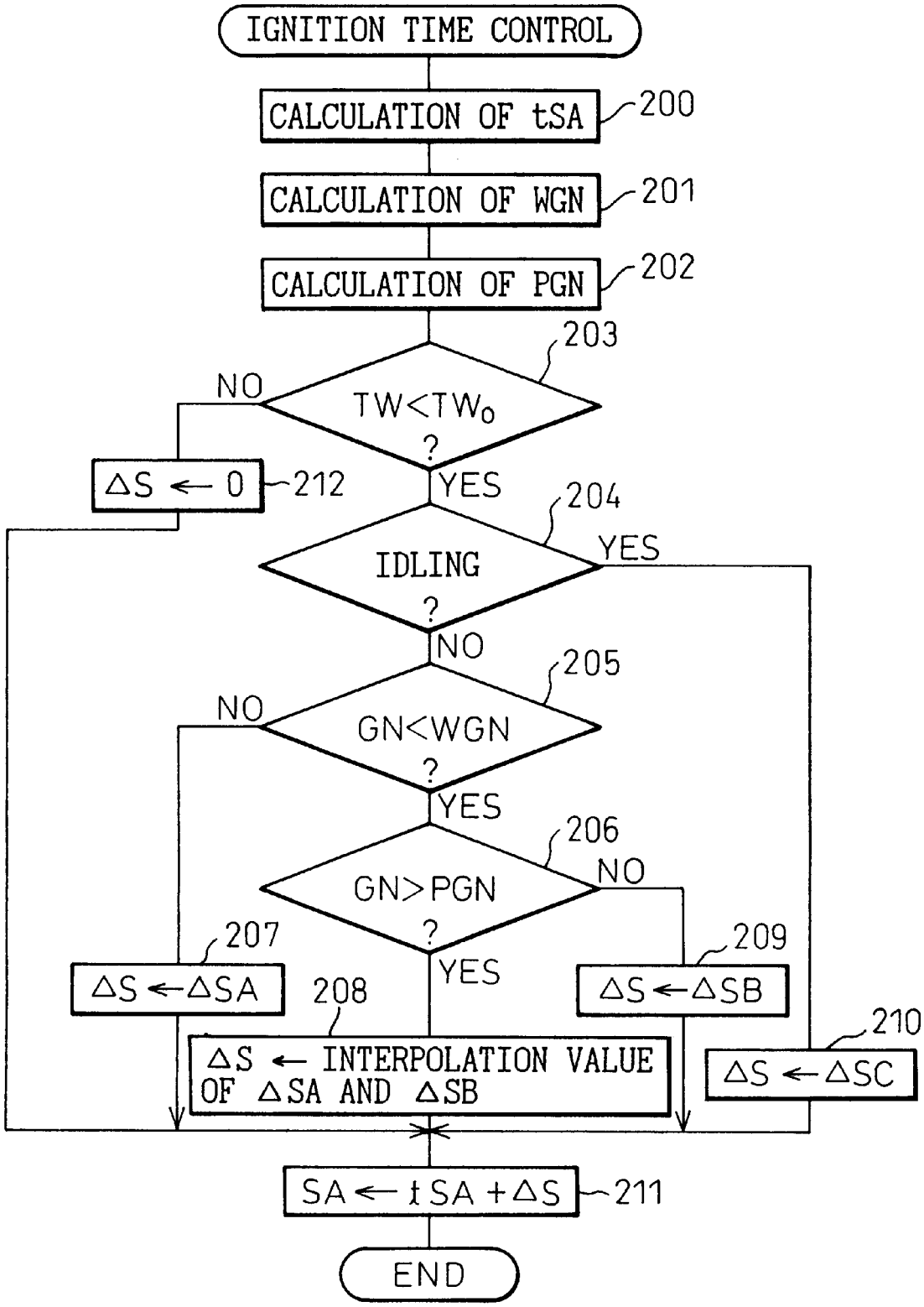
FIG. 7 is a flow chart for the control of the ignition timing.

FIG. 6 and FIG. 7 show another embodiment. In this embodiment, the reference value PGN when deciding to use the light load amount of advance ΔSB or the medium load amount of advance (interpolation value of ΔSB and ΔSA) as the amount of advance during engine warmup is changed in accordance with the atmospheric pressure PA. The reference value PGN becomes lower the lower the atmospheric pressure PA with respect to the normal atmospheric pressure as shown in FIG. 6.

Next, an explanation will be made of the routine for control of the ignition timing shown in FIG. 7.

Referring to FIG. 7, first, at step 200, the basic ignition timing tSA after engine warmup is completed is calculated from the map shown in FIG. 1. Next, at step 201, the reference value WGN is calculated from the relationship shown in FIG. 4 based on the atmospheric pressure detected by the atmospheric pressure sensor 30. Next, at step 202, the reference value PGN is calculated from the relationship shown in FIG. 6 based on the atmospheric pressure detected from the atmospheric pressure sensor 30. Next, at step 203, it is decided if the engine cooling water temperature TW detected from the water temperature sensor 17 is lower than a certain value $TW_O$, that is, if the engine is warming up. When $TW \geqq TW_O$, that is, when the engine warmup has finished, the routine proceeds to step 212, where the amount of advance ΔS is made zero. Next, at step 211, the amount of advance ΔS is added to the basic ignition timing tSA after the completion of warmup so as to calculate the final ignition timing SA (=tSA+ΔS).

On the other hand, when it is decided at step 203 that $TW < TW_O$, that is, the engine is warming up, the routine proceeds to step 204, where it is decided from the output signal of the idle switch 16 if the throttle valve 15 is in the idling position. When the throttle valve 15 is at the idling position, the routine proceeds to step 210, the amount of advance ΔSC shown in FIG. 3 is made the amount of advance ΔS, then the routine proceeds to step 211.

On the other hand, when it is decided at step 204 that the throttle valve 15 is not at the idling position, the routine proceeds to step 205, where it is decided if the mass flow rate GN of the intake air detected by the mass flow meter 13 is smaller than the reference value WGN or not. When GN≧WGN, the routine proceeds to step 207, where the amount of advance ΔSA shown in FIG. 3 is made the amount of advance ΔS, then the routine proceeds to step 211. Therefore, at this time, the final ignition timing SA is made the basic ignition timing (tSA+ΔSA) of engine warmup at the time of high load operation.

As opposed to this, when it is decided at step 205 that GN<WGN, the routine proceeds to step 206, where it is decided if the mass flow rate GN of the intake air is greater than the reference value PGN. When GN≦PGN, that is, at the time of engine light load, the routine proceeds to step 309, where the amount of advance ΔSB shown in FIG. 3 is made the amount of advance ΔS, then the routine proceeds to step 211. On the other hand, when it is decided at step 206 that GN>PGN, the routine proceeds to step 208, where the interpolation value of ΔSA and ΔSB shown in FIG. 3 is made the amount of advance ΔS, then the routine proceeds to step 211.

Figure 8:
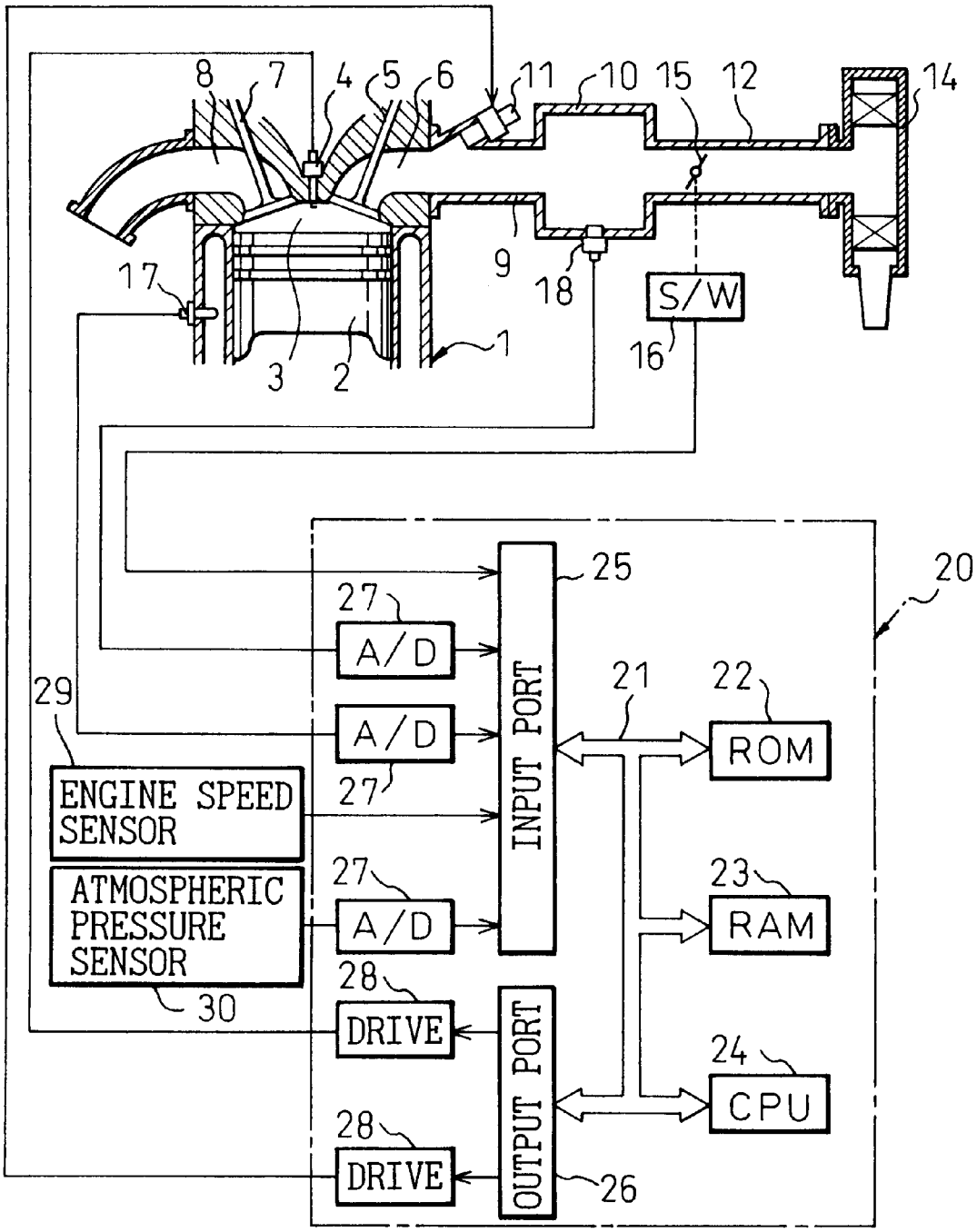
FIG. 8 is an overview of another embodiment of an internal combustion engine.
Figure 9:
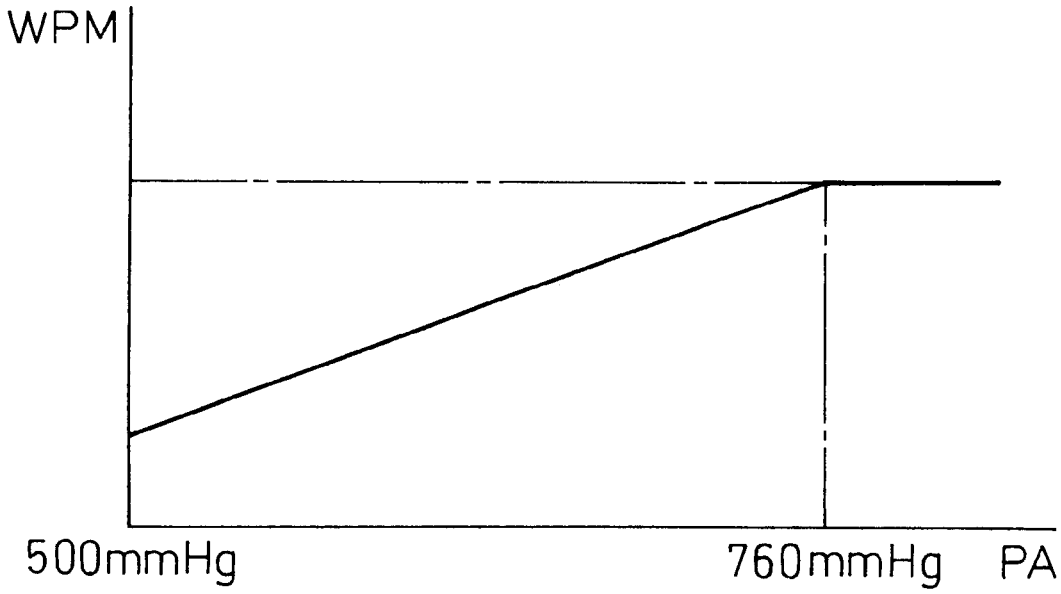
FIG. 9 is a view of a reference value GPM.
Figure 10:
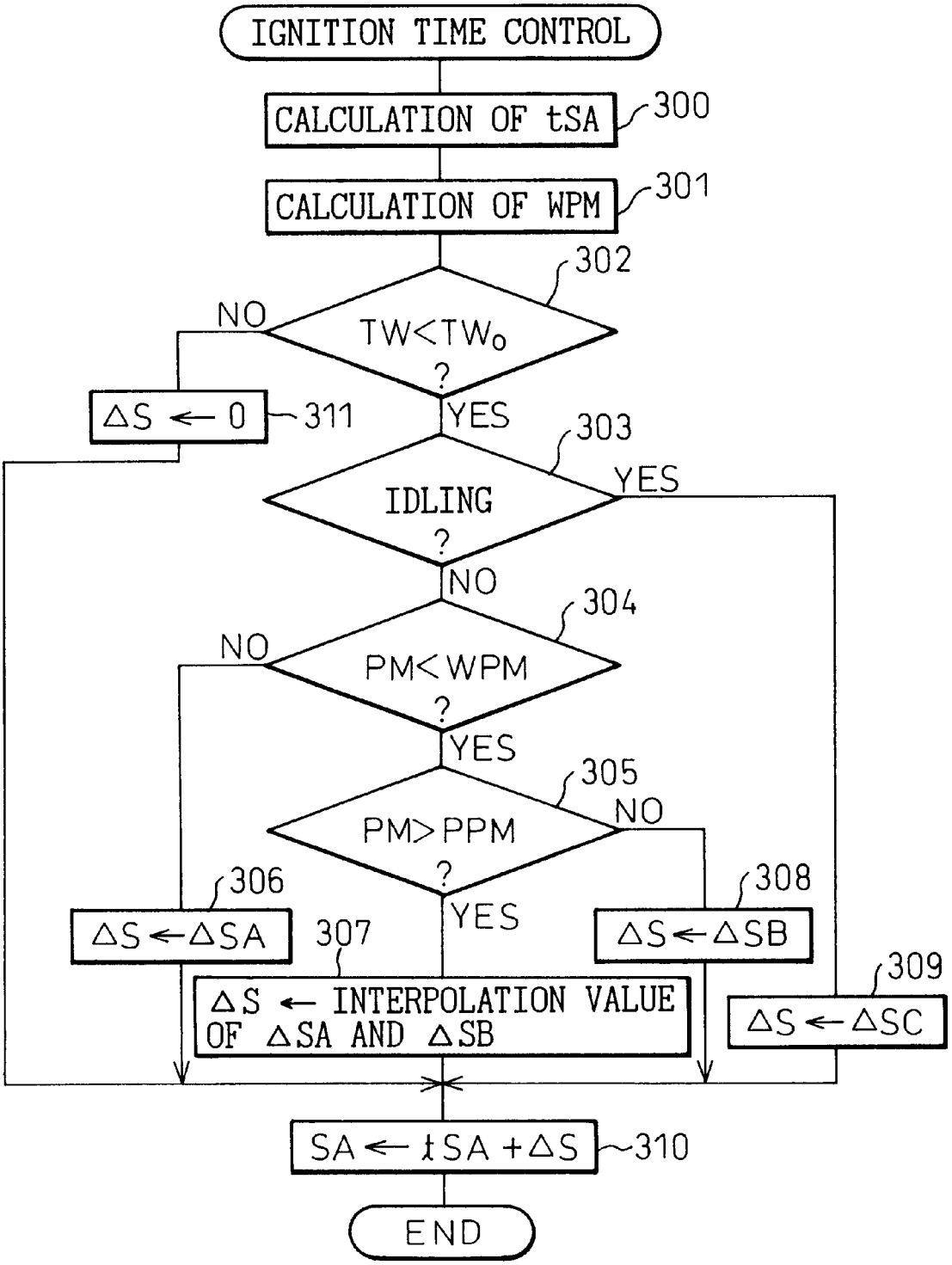
FIG. 10 is a flow chart for the control of the ignition timing.

Another embodiment is shown from FIG. 8 to FIG. 10. In this embodiment, as shown in FIG. 8, a pressure sensor 18 is attached in the surge tank 10. The pressure sensor 18 generates an output voltage proportional to the absolute pressure in the surge tank 10. This output voltage is input through the corresponding AD converter 27 to the input port 25. In this embodiment, the basic ignition timing tSA after the completion of the engine warmup is stored as a function of the absolute pressure in the surge tank 10 and the engine speed in advance in the ROM 22 in the form of a map. Further, in this embodiment, a decision is made based on the absolute pressure in the surge tank 10 whether to use the amount of advance ΔSA for a high load or to use the amount of advance for a medium load (interpolation value of ΔSB and ΔSA) as the amount of advance during engine warmup. The reference value GPM of this decision is made lower the lower the atmospheric pressure PA with respect to the normal atmospheric pressure as shown in FIG. 9.

Next, an explanation will be made of the routine for control of the ignition timing shown in FIG. 10.

Referring to FIG. 10, first, at step 300, the basic ignition timing tSA after the completion of warmup is calculated from the map. Next, at step 301, the reference value WPM is calculated from the relationship shown in FIG. 9 based on the atmospheric pressure detected by the atmospheric pressure sensor 30. Next, at step 302, it is decided whether the engine cooling water temperature TW detected from the water temperature sensor 17 is lower than a certain value $TW_O$, that is, whether the engine is in warmup operation or not. When $TW \geqq TW_O$, that is, when the engine warmup has been completed, the routine proceeds to step 311 and the amount of advance ΔS is made zero. Next, at step 310, the amount of advance ΔS is added to the basic ignition timing tSA after completion of engine warmup so as to calculate the final ignition timing SA (=tSA+ΔS).

On the other hand, when it is decided at step 302 that $TW < TW_O$, that is, when the engine is still warming up, the routine proceeds to step 303, where it is decided from the output signal of the idle switch 16 if the throttle valve 15 is at the idling position. When the throttle valve 15 is at the idling position, the routine proceeds to step 309, where the amount of advance ΔSC shown in FIG. 3 is made the amount of advance ΔS, then the routine proceeds to step 310. Therefore, at this time, the final ignition timing SA is made the basic ignition timing (tSA+ΔSC) of engine warmup at the time of idling operation.

On the other hand, when it is judged at step 303 that the throttle valve 15 is not in the idling position, the routine proceeds to step 304, where it is decided if the absolute pressure PM in the surge tank detected by the pressure sensor 18 is lower than the reference valve WPM. When PM≧WPM, the routine proceeds to step 306, where the amount of advance ΔSC shown in FIG. 3 is made the amount of advance ΔS, then the routine proceeds to step 310. Therefore, at this time, the final ignition timing SA is made the basic ignition timing (tSA+ΔSA) of engine warmup at the time of the high load operation. As shown in FIG. 9, the reference value WPN falls as the atmospheric pressure becomes lower, therefore even when the vehicle is being driven at a high altitude where the atmospheric pressure is low, if the accelerator pedal is stepped down on hard, the ignition timing is made the basic ignition timing (tSA+ΔSA) of engine warmup at the time of high load operation.

As opposed to this, when it is decided at step 304 that PM<WPM, the routine proceeds to step 305, where it is decided if the absolute pressure PM in the surge tank 10 is higher than a certain value PPM. When PM≦PPM, that is, at the time of an engine light load, the routine proceeds to step 308, where the amount of advance ΔSB shown in FIG. 3 is made the amount of advance ΔS, then the routine proceeds to step 310. Therefore, at this time, if the engine cooling water temperature TW is between $TW_f$ and $TW_O$ shown in FIG. 3, the ignition timing SA is retarded. On the other hand, when it is decided at step 305 that PM>PPM, the routine proceeds to step 307, where the interpolation value between ΔSA and ΔSB shown in FIG. 3 is made the amount of advance ΔS, then the routine proceeds to step 310. Therefore, at this time as well, if the engine cooling water temperature TW is between $TW_f$ and $TW_O$ shown in FIG. 3, the ignition timing SA is retarded.

According to the present invention, as explained above, even when a vehicle is operating at a high altitude where the atmospheric pressure is low, it is possible to obtain a high engine output when a driver of a vehicle desires a high engine output during engine warmup.

While the invention has been described by reference to specific embodiments chosen for purposes of illustration, it should be apparent that numerous modifications could be made thereto by those skilled in the art without departing from the basic concept and scope of the invention.

I claim:

1. An ignition timing control device for an engine having a spark plug, comprising:

ignition timing control means for controlling ignition timing, when the engine is warming up, to a warm-up reference ignition timing advanced relative to a warmed-up reference ignition timing when a representative value changing in accordance with atmospheric pressure is one of higher than a predetermined first reference value representing a high engine load and lower than a predetermined second reference value representing a low engine load, the ignition timing control means retarding the ignition timing relative to the warm-up reference ignition timing when the representative value is lower than the first reference value and higher than the second reference value; and reference value control means for lowering the first reference value while maintaining the second reference value unchanged when the atmospheric pressure falls below a normal atmospheric pressure.

2. An ignition timing control device for an engine as set forth in claim 1, wherein the representative value is a mass flow rate of intake air and the first reference value is a predetermined mass flow rate.

3. An ignition timing control device for an engine as set forth in claim 1, wherein the representative value is an absolute pressure and the first reference value is a predetermined absolute pressure.

4. An ignition timing control device for an engine as set forth in claim 1, further comprising means for deciding if the engine operating state is an idling operation, wherein, when the engine operating state is an idling operation, the ignition timing control means controls the ignition timing to the warm-up reference ignition timing.

5. An ignition timing control device for an engine as set forth in claim 1, wherein the ignition timing control means controls the amount of retard of the ignition timing in accordance with the representative value when the representative value is lower than the first reference value and higher than the second reference value.

6. An ignition timing control device for an engine as set forth in claim 5, wherein, when the representative value is lower than a third reference value lower than the first reference value and higher than the second reference value, the ignition timing control means makes an amount of ignition timing retard a predetermined maximum amount and reduces the amount of retard as the representative value increases above the third reference value.

7. An ignition timing control device for an engine as set forth in claim 6, wherein the representative value is a mass flow rate and of intake air and the third reference value is a predetermined mass flow rate.

8. An ignition timing control device for an engine as set forth in claim 7, wherein the predetermined mass flow rate is lowered the lower the atmospheric pressure is below the normal atmospheric pressure.

9. An ignition timing control device for an engine as set forth in claim 6, wherein the representative value is an absolute pressure value in an intake passage downstream of a throttle valve and the third reference value is a predetermined absolute pressure value.

10. An ignition timing control device for an engine as set forth in claim 1, further comprising means for detecting an engine cooling water temperature, wherein an amount by which the warm-up reference ignition timing is advanced relative to the warmed-up reference ignition timing is made larger as the engine cooling water temperature decreases and as the engine load increases and wherein the ignition timing control means retards the ignition timing relative to the warm-up reference ignition timing when the engine cooling water temperature is between a predetermined first temperature and a predetermined second temperature and the representative value is lower than the first reference value and higher than the second reference value, the second temperature being lower than the first temperature.

11. An ignition timing control device for an engine as set forth in claim 10, wherein the first temperature is the engine cooling water temperature at which the engine is deemed to be warmed up.

* * * * *